US010786417B2

(12) United States Patent
Shimada et al.

(10) Patent No.: US 10,786,417 B2
(45) Date of Patent: Sep. 29, 2020

(54) MOTION ASSIST DEVICE

(71) Applicant: HONDA MOTOR CO., LTD., Tokyo (JP)

(72) Inventors: Kei Shimada, Wako (JP); Toru Takenaka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 1197 days.

(21) Appl. No.: 15/134,725

(22) Filed: Apr. 21, 2016

(65) Prior Publication Data

US 2016/0310344 A1 Oct. 27, 2016

(30) Foreign Application Priority Data

Apr. 23, 2015 (JP) ..... 2015-088486

(51) Int. Cl.
*A61H 3/00* (2006.01)
*A61H 1/02* (2006.01)

(52) U.S. Cl.
CPC ..... *A61H 3/00* (2013.01); *A61H 1/0244* (2013.01); *A61H 2003/007* (2013.01); *A61H 2201/1215* (2013.01); *A61H 2201/1246* (2013.01); *A61H 2201/149* (2013.01); *A61H 2201/1463* (2013.01); *A61H 2201/164* (2013.01); *A61H 2201/165* (2013.01); *A61H 2201/1628* (2013.01); *A61H 2201/5069* (2013.01); *A61H 2205/08* (2013.01); *A61H 2205/108* (2013.01)

(58) Field of Classification Search
CPC ..... A61H 1/0237; A61H 1/0262; A61H 3/00; A61H 2003/001
See application file for complete search history.

(56) References Cited

U.S. PATENT DOCUMENTS

2011/0172570 A1* 7/2011 Shimizu ..... A61H 1/0244 601/35
2015/0216756 A1* 8/2015 Yamamoto ..... A61H 1/02 601/134
2016/0038368 A1* 2/2016 Lee ..... A61H 1/0244 623/24

FOREIGN PATENT DOCUMENTS

CN 104127300 A 11/2014
CN 203970821 U 12/2014
(Continued)

OTHER PUBLICATIONS

Office Action issued Chinese Patent Application No. 201610257388.2 dated Jul. 4, 2018.
(Continued)

*Primary Examiner* — Timothy A Stanis
(74) *Attorney, Agent, or Firm* — Armstrong Teasdale LLP

(57) ABSTRACT

A motion assist device for assisting a motion such as a walking motion of a user includes: a pair of femoral part support units (3L, 3R) configured to be worn by two femoral parts of a user, a single power source (4, 70) for producing power and a power transmission unit (20; 60; 91, 92) for transmitting the power of the power source to the femoral part support units as an opposite phase motion, wherein the power transmission unit includes a differential unit (22; 63, 64; 93, 94) for accommodating a same phase motion of the two femoral part support units. The device may further include a control unit (5) configured to actuate the power source when the femoral part support units are undergoing the opposite phase motion, and to keep the output end of the power source stationary when the femoral part support units are undergoing the same phase motion.

4 Claims, 11 Drawing Sheets

(56) References Cited

FOREIGN PATENT DOCUMENTS

| | | | |
|---|---|---|---|
| JP | 2000166997 | A | 6/2000 |
| JP | 2010000204 | A | 1/2010 |
| JP | 2016036902 | A | 3/2016 |

OTHER PUBLICATIONS

JP Office Action for related application 2015-088486 dated Sep. 25, 2018; 6 pp.
First Office Action of Chinese application No. 201610257388.2, dated Oct. 24, 2017, 11 pages.

* cited by examiner

MOTION ASSIST DEVICE

TECHNICAL FIELD

The present invention relates to a motion assist device for assisting a motion of a user such as a walking motion of a user.

BACKGROUND ART

Various motion assist devices in the form of walking assist devices have been proposed for clinical and other purposes. In a typical walking assist device, the movement of the legs of the user is detected, and a power unit for providing a walking assist force is controlled according to the detected movement of the legs. See JP2000-166997A, for instance.

The walking assist device disclosed in this patent document comprises an abdominal support unit configured to be worn on the abdomen of the user, a pair of femoral support units configured to be worn on the respective femoral parts of the user, a pair of electric motors supported on the abdominal support unit, a pair of power transmission mechanisms for transmitting the power of the electric motors to the respective femoral support units and a control unit for controlling the motions of the electric motors. In this device, the angles of the femoral parts with respect to the abdomen of the user are detected by angle detectors, and the control unit controls the electric motors according to the detected angles of the femoral parts. Typically, the motors are operated so as to assist the movements of the femoral parts. When the femoral parts are simultaneous swung forward, as it may indicate that the user desires to be seated on a chair, the assistance of the electric motors are interrupted so that the user may be allowed to be comfortably seated without being hampered by any assist force.

JP5021574B discloses a walking assist device comprising a pelvic support unit configured to be worn on the pelvic part of the user, a pair of power units attached to the pelvic support member and each having a rotational center line coinciding with the corresponding hip joint of the user and a pair of femoral support units attached to the output shafts of the respective power units. According to this prior art, because the power units and the femoral support units are directly connected to each other, the overall power transmission structure can be simplified.

According to the known walking assist devices, when a torque or a force is applied to the femoral part of the user, the reaction force is transmitted from the power unit to the pelvic part or the abdominal part of the user via the corresponding support unit. This may cause some discomfort to the user. Furthermore, because of the need to withstand the reaction force, the pelvic or abdominal support unit is required to have a high torsional stiffness, and this causes an increase in weight. When the user desires to sit or crouch, the motor which is not actuated applies a resistance in the form of a cogging torque of the electric motor to the femoral support unit, and thereby hampers the movement of the user. In particular, when a gear reduction unit and/or any mechanism that prevents external torque to be transmitted to the electric motor are provided in association with the electric motor, the user may be entirely prevented from sitting or crouching.

In the walking assist device proposed in JP5021574B, because the power units are on either side of the pelvic part of the user, the electric motors are required to have a low profile in order not to obstruct the movement of the arms of the user, and this causes an increase in cost. Even when low profile motors are used, the motors may still obstruct the swinging movement of the arms. Also, because the electric motors are integrally incorporated in the mechanism for transmitting the output power of the electric motors to the corresponding femoral support units, when the specifications of the electric motors are changed, the entire power units have to be redesigned.

SUMMARY OF THE INVENTION

In view of such problems of the prior art, a primary object of the present invention is to provide a motion assist device which can assist the opposite phase movement of the body parts of the user such as the lower limbs and upper limbs of the user as well as the same phase movement of the body parts of the user.

A second object of the present invention is to provide a motion assist device which can minimize the transmission of the reaction force of the power unit to the user.

A third object of the present invention is to provide a motion assist device which may be based a modular design so that various component parts of the power unit may be changed without requiring corresponding changes to be made to other parts of the power unit.

To achieve such objects, the present invention provides a motion assist device for assisting a motion of a user, comprising: a pair of body part support units (3L, 3R) configured to be worn by two body parts of a user; a single power source (4, 70) for producing power; and a power transmission unit (20; 60; 91, 92) for transmitting the power of the power source to the body part support units as an opposite phase motion; wherein the power transmission unit includes a differential unit (22; 63, 64; 93, 94) for accommodating a same phase motion of the two body part support units.

Owing to the provision of the differential unit, the two body parts such as femoral parts are allowed to undergo a same phase motion while the single power source can assist the opposite phase motion of the two body parts. Also, the reaction force caused by one of the body support units is transmitted to the other body part support unit so that any other part of the user's person is prevented from experiencing any discomfort.

According to a preferred embodiment of the present invention, the body parts are femoral parts of the user.

According to a certain aspect of the present invention, the differential unit includes a differential gear mechanism, and the power transmission mechanism includes a counter gear (38) provided between an output end of the differential gear mechanism and the corresponding body part support unit.

Thereby, the power transmission unit and the different unit can be constructed as highly simple units.

According to another aspect of the present invention, the power source comprises an electric motor including an outer member (18) rotatably supported by a fixed frame and an inner member (19) rotatably supported by the outer member, and wherein the differential unit comprises a bearing (53) for rotatably supporting the outer member on the fixed frame, and the power transmission unit includes a first power transmission unit (20L) for connecting the outer member with one of the body part support units and a second power transmission unit (20R) for connecting the inner member with the other body part support unit.

This arrangement also allows the power transmission unit and the different unit to be constructed as highly simple units.

According to yet another aspect of the present invention, the power source includes an output shaft (19*a*), and the power transmission unit comprises a primary rack and pinion mechanism (61) and a pair of secondary rack and pinion mechanisms (62A, 62B), the primary rack and pinion mechanism including a primary pinion (61) attached to the output shaft and a pair of primary racks (62A, 62B) slidably supported by a fixed frame and meshing with the primary pinion so as to convert a rotational movement of the primary pinion into linear movements of the primary racks directed in mutually opposite directions, each secondary rack and pinion mechanism including a secondary pinion (65, 66) rotatably supported by the corresponding primary rack and a pair of secondary racks (67A, 67B, 68A, 68B) slidably supported by the corresponding primary rack and meshing with the secondary pinion so as to convert a rotational movement of the secondary pinion into linear movements of the secondary racks directed in mutually opposite directions, the power transmission unit including a pair of pulleys (35L, 35R) attached to the body part support units, respectively, and a pair of belts (69L, 69R) passed around the respective pulleys, two ends of each belt being connected to one of the secondary racks of one of the secondary rack and pinion mechanisms, and to one of the secondary racks of the other secondary rack and pinion mechanism.

According to yet another aspect of the present invention, the power source comprises a double acting displacement pump (70) including a first pump chamber (76*a*) and a second pump chamber (77*a*), and the power transmission unit includes a pair of fluid actuators (71L, 71R) provided in association with two body parts of the user, each fluid actuator including a first fluid chamber (82*a* L, 82*a*R) and a second fluid chamber (83*a*L, 83*a*R), and a passage system (91-94) communicating the first pump chamber with the first fluid chamber of one of the actuators and the second fluid chamber of the other actuator, and the second pump chamber with the second fluid chamber of the one actuator and the first fluid chamber of the other actuator.

The present invention also provides a motion assist device for assisting a motion of a user, comprising: a pair of body part support units (3L, 3R) configured to be worn by two body parts of a user; a single power source (4, 70) for producing power at an output end thereof; and a power transmission unit (20; 60; 91, 92) for transmitting the power of the power source to the body part support units as an opposite phase motion, the power transmission unit including a differential unit (22; 63, 64; 93, 94) for accommodating a same phase motion of the two body part support units; and a control unit (5) configured to actuate the power source when the body part support units are undergoing the opposite phase motion, and to keep the output end of the power source stationary when the body part support units are undergoing the same phase motion.

According to this arrangement, owing to the provision of the differential unit, no power is drawn from or supplied to the power unit when the two body part support members are undergoing a same phase motion so that the two body parts can be moved without being hampered by the power unit. Meanwhile, when the two body part support members are undergoing an opposite phase motion, the power from the power source can be transmitted to the two body part support members to assist the motion of the body parts such as femoral parts of the user. Also, the reaction force caused by one of the body support units is transmitted to the other body part support unit so that any other part of the user's person is prevented from experiencing any discomfort.

According to the present invention, an opposite phase motion of the two body parts of the user can be assisted by the power from the power source while a same phase motion of the two body parts of the user is enabled without being hindered by the power source, and the two body part support members can be actuated by using only one power source. Furthermore, the reaction force caused by one of the body support units is transmitted to the other body part support unit so that any other part of the user's person is prevented from experiencing any discomfort.

DESCRIPTION OF THE PREFERRED EMBODIMENT(S)

Preferred embodiments of the present invention are described in the following with reference to the appended drawings.

First Embodiment

A walking assist device 1 given as a first embodiment of the present invention is described in the following with reference to FIGS. 1 to 5. The walking assist device 1 is generally symmetric about the sagittal plane of the user P, and some of the components are provided on either side of the user. Such parts are denoted with numerals followed by a suffix L or R to indicate on which side (either left or right side) of the user the particular component is located. However, when such components are collectively referred to, the suffices may be omitted for the convenience of description.

Figure 1:
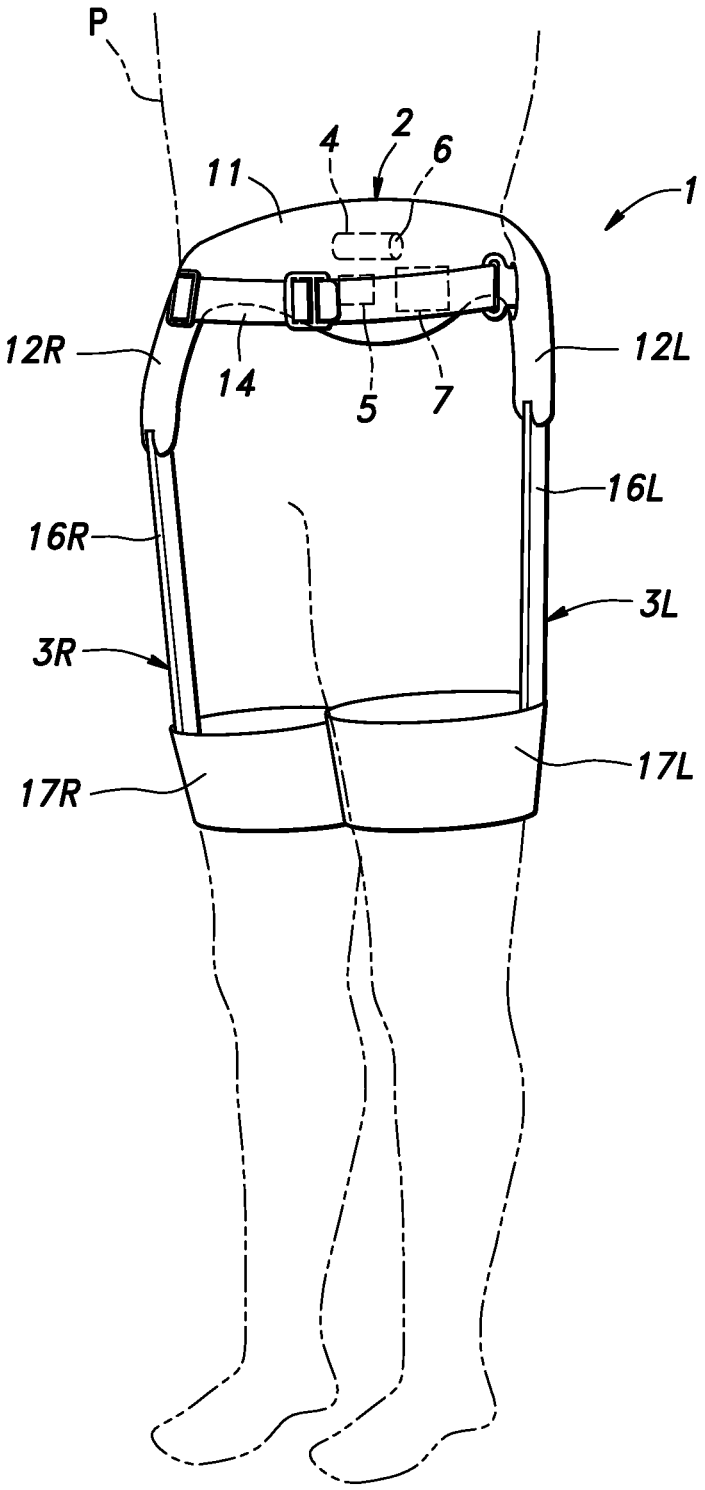
FIG. 1 is a perspective view of a walking assist device given as a first embodiment of the present invention as being worn by a user indicated by imaginary lines.
Figure 2:
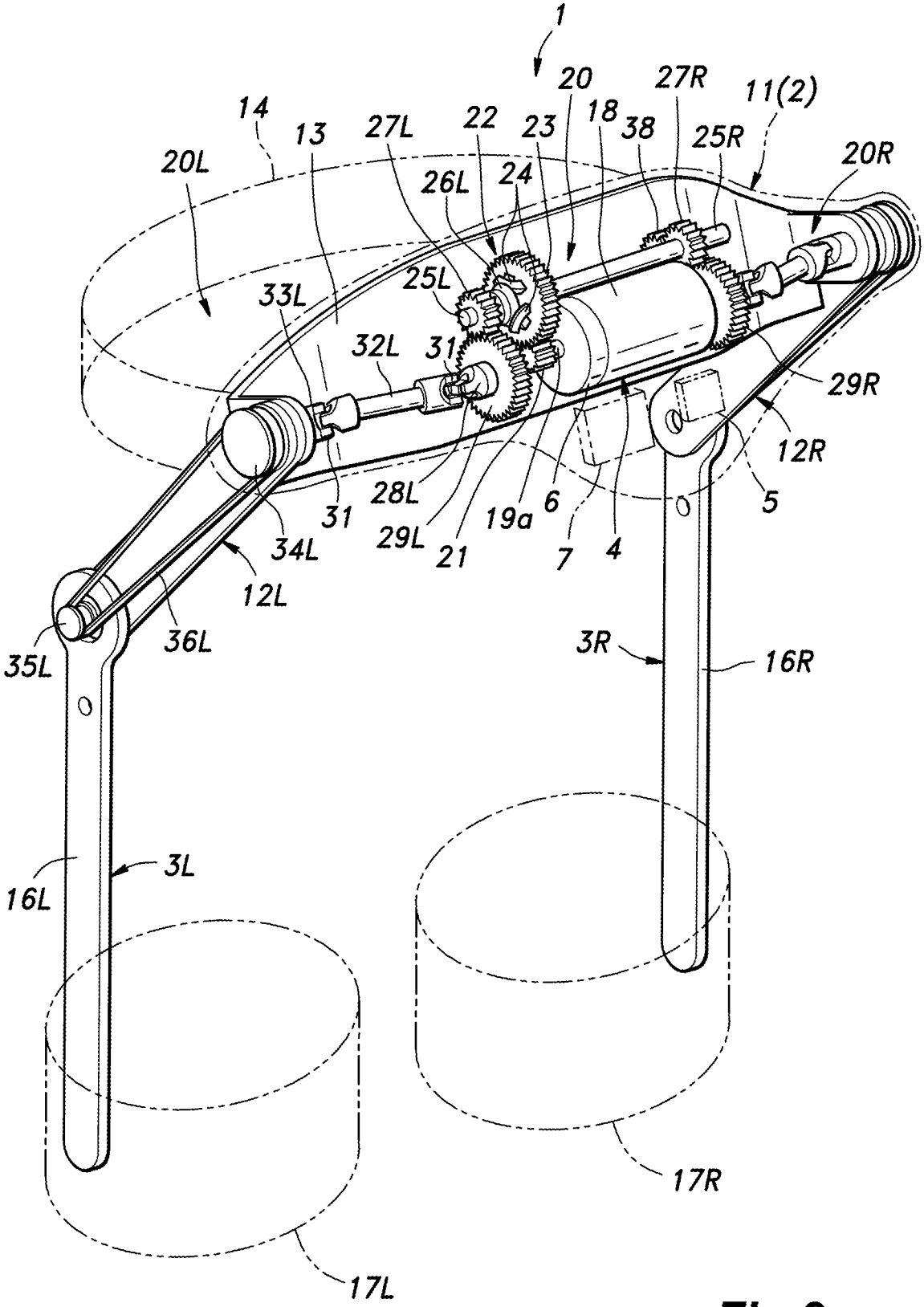
FIG. 2 is a rear perspective see-through view showing an essential part of the walking assist device.

As shown in FIGS. 1 and 2, the walking assist device 1 comprises a pelvic support unit 2 worn on a pelvic part of a user P, a pair of femoral support units 3L and 3R worn on femoral parts of the user P, respectively, a single electric motor 4 positioned in the pelvic support unit 2 to provide the power required to cause a reciprocating angular movement to each femoral support unit 3, a control unit 5 for controlling the motion of the electric motor 4, an angular position sensor 6 incorporated in the electric motor 4 for detecting the angular position of the electric motor 4 and a battery 7 for providing electric power to the electric motor 4 and the control unit 5.

The pelvic support unit 2 is provided with a pelvic support assembly 11 positioned on the backside of the pelvic part of the user P and a pair of side frames 12L and 12R connected to either lateral end of the pelvic support assembly 11. The pelvic support assembly 11 includes a pelvic frame 13 (FIG. 2) made of hard plastic or any other stiff material, and the front side of the pelvic frame 13 is lined with a pad or a cover member. A pelvic belt 14 is connected to either lateral end of the pelvic frame 13 via a buckle or other device so that the user may pass the pelvic belt 14 in front of the user in a detachable manner while holding the pelvic support assembly 11 on the back side of the pelvic part of the user to keep the pelvic support assembly 11 fixed in position during operation.

Each side frame 12 may consist of a hollow arm member made of hard plastic formed integrally with the pelvic frame 13, and extending from the corresponding lateral end of the pelvic frame 13 (obliquely in the forward and downward direction) to the part adjoining the hip joint of the user P. In another embodiment, each side frame 12 is provided separately from the pelvic frame 13, and is detachably attached thereto by using a suitable fastener. Alternatively, each side frame 12 may be connected to the pad or the cover member of the pelvic support assembly 11.

Each femoral support unit 3 is provided with a femoral arm member 16 having a base end supported by the free (lower) end of the corresponding side frame 12 in a rotatable manner about a laterally extending axial line and a retainer 17 attached to the free (lower) end of the femoral arm member 16 for retaining the corresponding femoral part of the user. The femoral arm member 16 is made of hard plastic, and extends substantially downward along the side of the femoral part of the user, and is configured to swing about the base end thereof in the fore and aft direction. The retainer 17 may be made of a combination of different materials so that the necessary mechanical strength and stiffness may be attained while providing a maximum comfort to the user. In the illustrated embodiment, the retainer 17 consists of a fabric belt, and is configured to be detachably wrapped around the corresponding femoral part of the user. Alternatively, the retainer 17 may include a pair of plate members that are applied to the front and rear sides of the femoral part of the user so favorably distribute the pressure the retainer 17 applies to the femoral part of the user.

Figure 3:
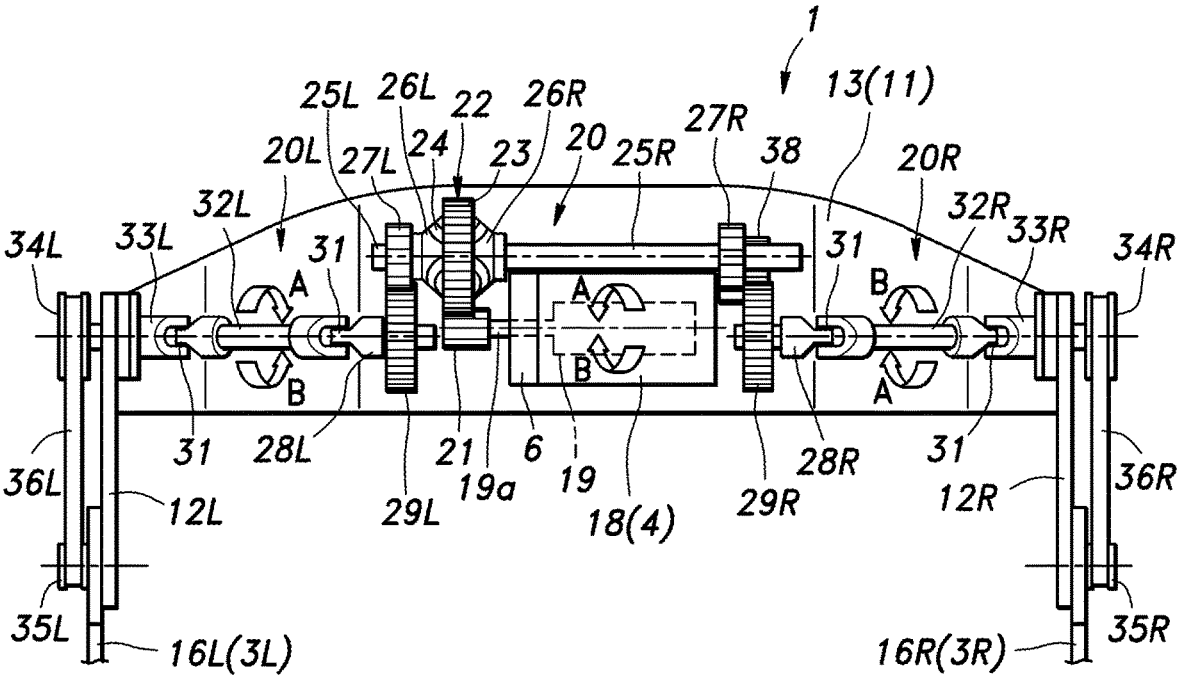
FIG. 3 is a rear view of the internal structure of the walking assist device.

As shown in FIGS. 2 and 3, the electric motor 4 includes an outer member 18 (outer stator, see FIG. 3) fixed to the pelvic frame 13 and an inner member 19 (inner rotor, see FIG. 3) rotatably received in the outer member 18 and provided with an output shaft 19*a* extending laterally out of the outer member 18. The electric motor 4 is mounted on the laterally central part of the pelvic frame 13. The electric motor 4 receives a supply of electric power from the battery 7 via the control unit 5. Thus, the electric motor 4 rotates the inner member 19 and the output shaft 19*a* in the directions indicated by arrows A and B in FIG. 3 under the control of the control unit 5, and provides the required assist toque to the femoral parts of the user.

A power transmission mechanism 20 is provided on the pelvic frame 13 and the side frames 12 so as to transmit the power of the electric motor 4 to the femoral parts of the user P via the femoral support units 3.

As shown in FIGS. 2 and 3, a pair of first drive shafts 25L and 25R are rotatably supported by the pelvic frame 13 in a mutually aligned relationship. A differential gear mechanism 22 is connected between the opposing ends of the first drive shafts 25L and 25R. The differential gear mechanism 22 includes a ring gear 23 serving as an input gear and three pinions 24 each consisting of a small bevel gear and supported by the ring gear 23 at a regular angular interval (at a 120 degree interval) so as to be rotatable around a radial line of the ring gear 23, a pair of side gears 26L and 27R disposed coaxially with the ring gear 23 and meshing with the pinions 24 from either lateral side. The opposing ends of the first drive shafts 25L and 25R are connected to the corresponding side gears 26L and 27R, respectively.

A pinion 21 fitted on the output shaft 19*a* of the inner member 19 of the electric motor 4 meshes with an external gear formed on the outer circumference of the ring gear 23 of the differential gear mechanism 22. The left end of the left first drive shaft 25L is fitted with a small spur gear 27L, and the right end of the right first drive shaft 25R is fitted with a small spur gear 27R.

The differential gear mechanism 22 distributes the output torque of the electric motor 4 to the two first drive shafts 25 evenly while accommodating the difference in the rotational speed between the two first drive shafts 25. For the convenience of description, the power transmission mechanism 20 is divided into a left power transmission mechanism 20L for transmitting power from the left first drive shaft 25L to the left femoral support unit 3L, and a right power transmission mechanism 20R for transmitting power from the right first drive shaft 25R to the right femoral support unit 3R.

The left power transmission mechanism 20L is described in the following. The left small spur gear 27L meshes with a left large spur gear 29L fitted on a left second drive shaft 28L rotatably supported by the pelvic frame 13 in parallel with the left first drive shafts 25L.

The left second drive shaft 28L is connected, via a shaft coupling assembly consisting of a pair of Hook joints 31 and a left third drive shaft 32L, to a left fourth drive shaft 33L which is rotatably supported by the base end of the left side frame 12L. The outer end of the left fourth drive shaft 33L is fitted with a large pulley 34L, and the upper end of the left femoral arm member 16L is fitted with a small pulley 35L. A belt 36L is passed around the two pulleys 34L and 35L so that the rotation of the left fourth drive shaft 33L is converted into the angular movement of the femoral arm member 16L.

The right power transmission mechanism 20R is described in the following. The right small spur gear 27R meshes with a counter gear 38 rotatably supported by the pelvic frame 13, and the counter gear 38 further meshes with a right large spur gear 29R fitted on a right second drive shaft 28 rotatably supported by the pelvic frame 13. The right second drive shaft 28 is connected, via a shaft coupling assembly consisting of a pair of Hook joints 31 and a right third drive shaft 32R, to a right fourth drive shaft 33R which is rotatably supported by the base end of the right side frame 12R. The outer end of the right fourth drive shaft 33R is fitted with a large pulley 34R, and the upper end of the right femoral arm member 16R is fitted with a small pulley 35R. A belt 36R is passed around the two pulleys 34R and 35R so that the rotation of the right fourth drive shaft 33R is converted into the angular movement of the femoral arm member 16R.

Owing to the presence of the counter gear 38, the rotational motion of the electric motor 4 is distributed to the fourth drive shafts 33L and 33R as motions of opposite phases. When there is no difference between the loads of left and right femoral support units 3L and 3R, these two femoral arm members 16L and 16R move in opposite phases without causing any differential motion in the differential gear mechanism 22.

More specifically, as shown in FIG. 3, when the output shaft 19*a* of the electric motor 4 turns in the direction indicated by arrow A, the left fourth drive shaft 33L rotates in the same direction as indicated by arrow A. On the other hand, the right fourth drive shaft 33R rotates in the opposite direction as indicated by arrow A owing to the inclusion of the counter gear 38. The rotational motions of the fourth drive shafts 33L and 33R are converted into the pivotal movements of the femoral arm members 16L and 16R, respectively, of the corresponding directions owing to the transmission of power by the belts 36L and 36R, respectively.

At the same time, owing to the presence of the differential gear mechanism 22, the left and right femoral support units 3L and 3R are enabled to move forward or rearward simultaneously without involving the rotation of the electric motor 4, or in other words, can move in an same phase relationship. Furthermore, if the femoral arm members 16L and 16R are subjected to external loads or encounter obstructions, owing to the presence of the differential gear mechanism 22, the femoral arm members 16L and 16R are given with freedom to move in any phase relationship including the same phase relationship and the opposite phase relationship. For instance, when the electric motor 4 is not powered, the user P may squat or sit down, and stand up without encountering any undue resistance.

For instance, when the two femoral support unit 3L and 3R are both swung forward (to allow the user P to squat) (a same phase motion), the left third drive shaft 32L rotates in the direction indicated by arrow A while the right third drive shaft 32R rotates in the direction indicated by arrow B so that the first drive shafts 25L and 25R are caused to rotate in the opposite directions at the same speed. The planetary pinions 24 then accommodate the mutually opposite rotations of the bevel side gears 26L and 26R so that the ring gear 23 remains stationary.

Therefore, the user is enabled to bend the lower limbs in the same direction (for sitting, for instance) or extend the lower limbs in the same direction (for standing up, for instance) without causing the rotation of the electric motor 4 (against the cogging torque of the electric motor 4) and without encountering any significant resistance.

Referring to FIGS. 1 and 2 once again, the angular position sensor 6 is incorporated in the electric motor 4 in the illustrated embodiment, and may consist of a rotary encoder that detects the absolute angular position of the inner member 19 relative to the outer member 18 which is fixed to the pelvic frame 13. The output signal of the angular position sensor 6 is supplied to the control unit 5.

The control unit 5 which is accommodated in the pelvic support unit 2 essential consists of an electronic circuit unit including CPU, RAM, ROM and a peripheral circuit, and executes the control process for controlling the operation of the electric motor 4 or the assist force $\tau$ that is to be applied to the user P. The CPU of the control unit 5 is programmed to execute required computational processes by reading out commands and necessary data from a storage unit (memory) not shown in the drawings.

The battery 7 is accommodated in the pelvic support unit 2, and supplies electric power to the control unit 5 and the electric motor 4. The control unit 5 and/the battery 7 may also be accommodated in the femoral support units 3, or may be provided separately from the walking assist device 1 and connected to the electric motor 4 via wiring.

When powered up, the control unit 5 controls the electric power supplied from the battery 7 to the electric motor 4 such that the necessary assist force (assist torque) ti as determined by the control unit 5 from the detection signal of the angular position sensor 6 is applied to the femoral parts of the user P via the femoral support units 3.

Figure 4:
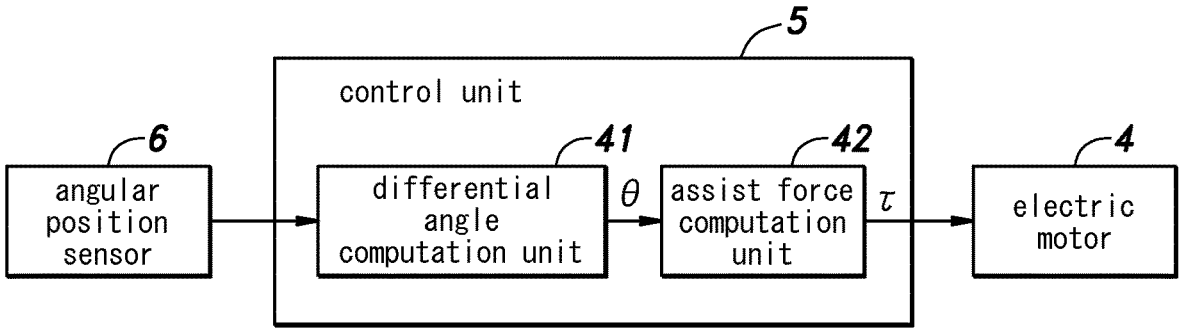
FIG. 4 is a block diagram of a control unit for controlling the electric motor of the walking assist device.
Figure 5:
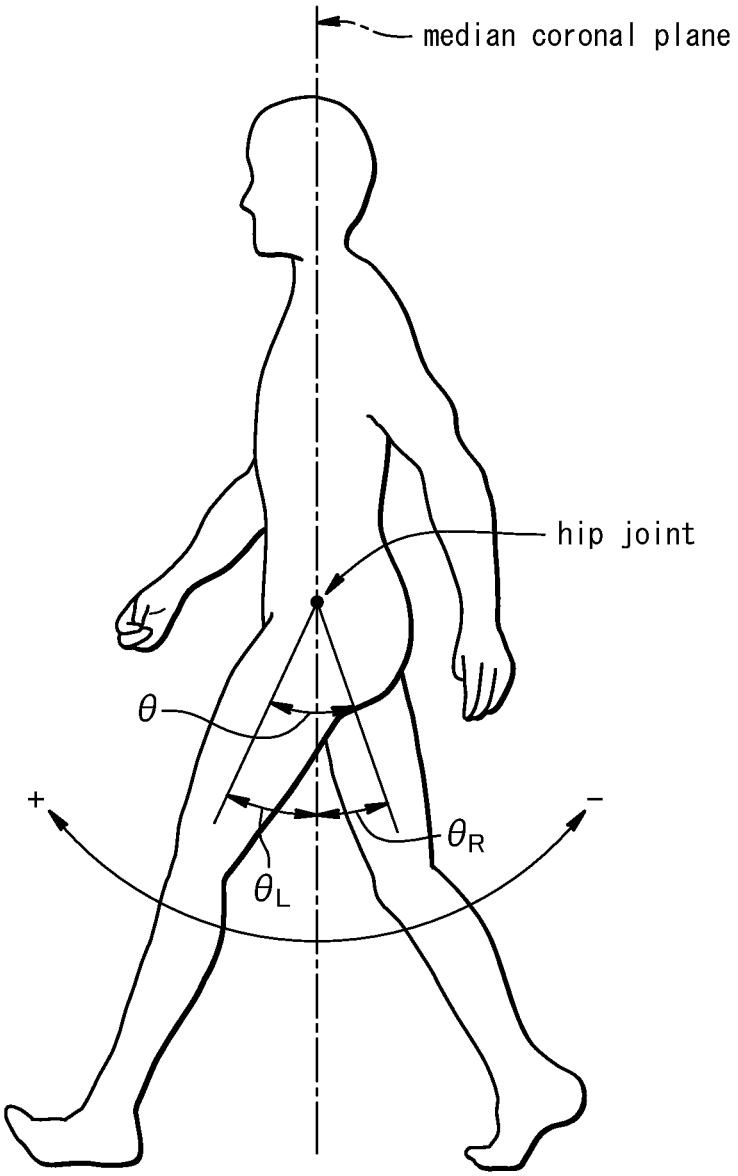
FIG. 5 is a diagram defining the various angles used for describing the action of the walking assist device.

The structure of the control unit 5 is described in the following. As shown in FIG. 4, the control unit 5 includes a differential angle computation unit 41 for computing the differential angle $\theta$ between the two femoral support units 3 or the two femoral parts of the user P and an assist force computation unit 42 for computing the assist force $\tau$ that is required to be applied to the femoral parts of the user by executing a computational process (which is discussed hereinafter) based on the differential angle $\theta$ computed by the differential angle computation unit 41.

The differential angle $\theta$ is defined as the difference between the femoral part angles $\theta$L and $\theta$R of the two femoral parts of the user P which are in turn defined as the angles between the respective center lines of the femoral parts of the user P and the vertical line as projected on the sagittal plane. The femoral part angles $\theta$L and $\theta$R are positive in sign when the corresponding femoral part is swung forward (is bent), and negative in sign when the corresponding femoral part is swung rearward (is extended). Therefore, the differential angle $\theta$ obtained by subtracting one of the femoral part angles $\theta$R (right femoral part angle, for instance) from the other femoral part angle $\theta$L is positive in sign when the left leg is ahead of the right leg, and negative in sign when the right left is ahead of the left leg.

The differential angle $\theta$ may be directly detected by measuring the rotational angle of the inner member 19 relative to the outer member 18. For this purpose, the detection value of the angular position sensor 6 when the differential angle $\theta$ is zero is set and stored as the zero point in the control unit 5 so that the differential angle computation unit 41 computes the differential angle $\theta$ by subtracting the zero point value from the angular position of the electric motor 4 detected by the angular position sensor 6 and multiplying a prescribed conversion factor (determined by the gear ratio) to the difference. The differential angle computation unit 41 execute this computation process at a prescribed process cycle.

When the user has moved the left leg ahead of the right leg from the state where the differential angle $\theta$ is zero, the rotational angle of the electric motor 4 increases from the zero point, and the differential angle computation unit 41 computes the differential angle $\theta$ as a positive value. Conversely, when user has moved the right leg ahead of the left leg from the state where the differential angle $\theta$ is zero, the rotational angle of the electric motor 4 decreases from the zero point, and the differential angle computation unit 41 computes the differential angle $\theta$ as a negative value. When the user has moved the both legs either forward or rearward at the same speed from the state where the differential angle $\theta$ is zero, the rotational angle of the electric motor 4 remains at the zero point, and the differential angle $\theta$ computed by the differential angle computation unit 41 is zero.

The assist force computation unit 42 computes the differential angular speed $\omega$ from the differential angle $\theta$ computed by the differential angle computation unit 41, and by executing an inverse tangent computation, computes a differential phase angle $\phi$ in a phase plane of the differential angle $\theta$ and the differential angular speed $\omega$. The assist force $\tau$ for each femoral part is computed from the obtained differential phase angle $\phi$. Alternatively, the assist force computation unit 42 computes the differential angular speed $\omega$ and the walking frequency from the differential angle $\theta$, and computes the differential phase angle $\phi$ in the phase plane of the differential angle $\theta$ and the differential angular speed $\omega$. At the same time, an oscillator phase angle $\phi c$ of a phase oscillator which oscillates in synchronism with the differential phase angle $\phi$ at a resonant frequency corresponding to the walking frequency is computed, and the assist force $\tau$ for each femoral part is computed from the obtained differential phase angle $\phi$ and the oscillator phase angle $\phi c$.

By computing the assist force $\tau$ with the assist force computation unit 42 in this manner, when the femoral parts of the user wearing the respective femoral support units 3 are undergoing an opposite phase motion, because this causes changes in the differential angle $\theta$, the assist force $\tau$ which is either positive (bending motion) or negative (extending motion) in sign is computed, and the electric motor 4 produces the corresponding power. Conversely, when the femoral parts of the user wearing the respective femoral support units 3 are undergoing a same phase motion, because this causes no change in the differential angle $\theta$, the assist force $\tau$ is zero, and the electric motor 4 does not produce any power.

As discussed earlier with reference to FIG. 3, the output torque of the electric motor 4 is equally distributed between the right and left femoral support units 3L and 3R via the differential gear mechanism 22, and is transmitted to the right and left femoral support units 3L and 3R in an opposite phase relationship owing to the intervention of the counter gear 38. Also, owing to the differential gear mechanism 22, the rotational speed of the electric motor 4 is distributed between the right and left femoral support units 3L and 3R in a manner corresponding to the respective loading on the right and left femoral support units 3L and 3R.

This walking assist device 1 thus includes the single electric motor 4 serving as a power source and a power transmission mechanism 20 for transmitting the power of the electric motor 4 to the femoral support units 3 as an opposite phase motion, and the powered transmission mechanism includes the differential gear mechanism 22 for distributing the power of the electric motor 4 between the two femoral support units 3, so that the two legs of the user P are enabled to move in an opposite phase relationship with ease, and the opposite phase assist to the two legs of the user P can be achieved by using the single electric motor 4. The reaction force produced by one of the femoral support unit 3 in providing the assist force to the corresponding femoral part of the user is transmitted to the other femoral support unit 3 so that the reaction force is not transmitted to any part of the user except for the femoral parts of the user P. Therefore, the user is prevented from experiencing any discomfort owing to the application of the reaction force to any other part of the user's body. Also, the stiffness of the pelvic support unit 2 is not required to be unduly stiff. Furthermore, owing to the favorable arrangement of the power transmission mechanism 20, the specifications of the electric motor 4 may be changed without causing any significant design change to any other part of the walking assist device 1.

According to the power transmission mechanism 20 of the illustrated embodiment, the power of the electric motor 4 can be transmitted to the two femoral support units 3 in opposite phase by using a simple structure combining the differential gear mechanism 22 and the counter gear 38 provided between the right first drive shaft 25R connected to one of the output ends of the differential gear mechanism 22 and the right femoral support unit 3R.

Second Embodiment

Figure 6:
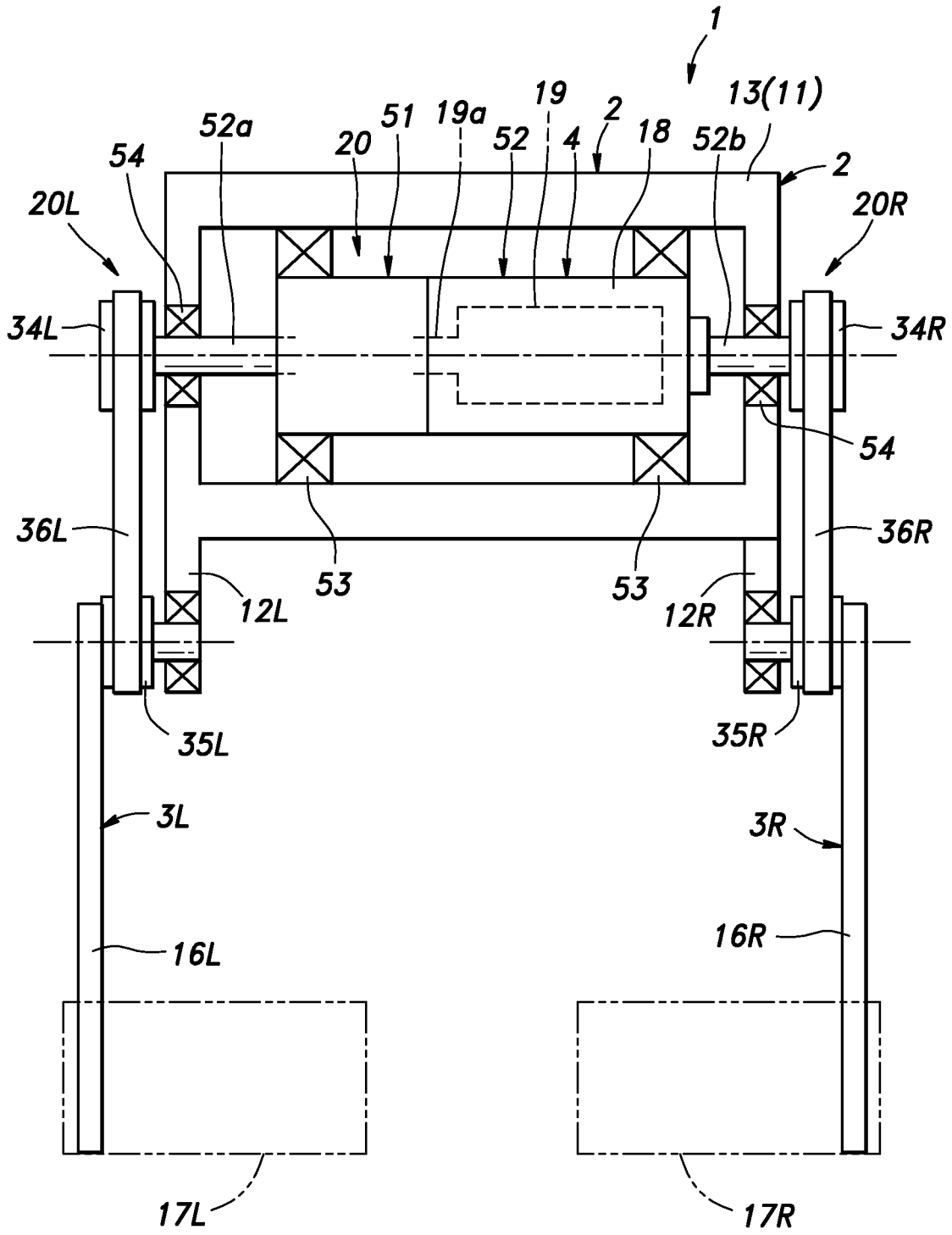
FIG. 6 is a diagram of a walking assist device given as a second embodiment of the present invention.

The walking assist device 1 given as a second embodiment of the present invention is described in the following with reference to FIG. 6. In FIG. 6, the parts corresponding to those of the preceding embodiment are denoted with like numerals without necessarily repeating the discussion of such parts in the following description.

The power transmission mechanism 20 of the second embodiment is modified from that of the first embodiment in the structure of the power transmission mechanism 20. In particular, a reduction gear mechanism is connected to the output shaft 10*a* of the electric motor 4, and the electric motor 4 is incorporated in the power transmission mechanism 20. The electric motor 4 and the reduction gear mechanism 51 jointly form an integral electric motor unit 52.

The field system of the electric motor 4 may consist of either electromagnets or permanent magnets. In the case of an electromagnetic field system, either the outer member 18 or the inner member 19 may serve as the armature. When supplied with electric power, the electric motor 4 produces a torque that tends to rotate the outer member 18 and the inner member 19 relative to each other. The reduction gear mechanism 51 is not essential for the present invention, and may be omitted or may consist of any per se known speed reduction unit.

The electric motor unit 52 (or the outer member 18 thereof and the housing of the reduction gear mechanism 51) is rotatably supported by the pelvic frame 13 via a pair of bearings 53, in a coaxial relationship to the output shaft 19*a* of the electric motor 4.

A first output shaft 52*a* of the reduction gear mechanism 51 or the electric motor unit 52 extends rearward from the left end of the electric motor unit 52 to transmit the rotation of the inner member 19 of the electric motor 4. A second output shaft 52*b* which is fixed to (or integrally formed with) the right end of the outer member 18 of the electric motor 4 extends rightward in a coaxial relationship to the first output shaft 52*a* to transmit the rotation of the outer member 18 of the electric motor 4.

For the convenience of description, the power transmission mechanism 20 is divided into a left power transmission mechanism 20L for transmitting power from the first output shaft 52*a* (on the left) to the left femoral support unit 3L and a right power transmission mechanism 20R for transmitting power from the second output shaft 52*b* (on the right) to the right femoral support unit 3R.

In the left power transmission mechanism 20L, the first output shaft 52*a* is rotatably supported by the pelvic frame 13 and/or the left side frame 12L via a bearing 54, and a left pulley 34L is integrally attached to the left end of the first output shaft 52*a*. A belt 36L is passed around the left pulley 34L and the left small pulley 35L which is fixedly attached to the left femoral arm member 16L and rotatably supported by the left side frame 12L so that the torque of the electric motor 4 can be transmitted to the left small pulley 35L.

In the right power transmission mechanism 20R, the second output shaft 52*b* is rotatably supported by the pelvic frame 13 and/or the right side frame 12R via a bearing 54, and a right pulley 34R is integrally attached to the right end of the second output shaft 52*b*. A belt 36R is passed around the right pulley 34R and the right small pulley 35R which is fixedly attached to the right femoral arm member 16R and rotatably supported by the right side frame 12R so that the torque of the electric motor 4 can be transmitted to the right small pulley 35R.

The mode of operation of the power transmission mechanism 20 is described in the following. For the convenience of description, the reduction gear mechanism 51 is omitted from the following discussion.

When the electric motor 4 is powered, the outer member 18 and the inner member 19 are subjected to a torque which is equal in magnitude and opposite in direction. Therefore, owing to the presence of the bearings 53 that rotatably support the outer member 18 of the electric motor 4, the electric motor 4 is provided with the function to distribute the output torque thereof between the two femoral support units 3, and the function to transmit the torque to the two femoral support units 3 in a mutually opposite phase relationship. Owing to the presence of the bearings 53, the power transmitted to the first output shaft 52*a* and the second output shaft 52*b* are transmitted to the two femoral support units 3 via the left power transmission mechanism 20L and the right power transmission mechanism 20R, respectively.

Furthermore, owing to the presence of the bearings 53, the two femoral support units 3 can be moved jointly in the forward or rearward direction without rotating the electric motor 4 (or causing no relative rotation between the outer member 18 and the inner member 19). In other words, the two femoral parts 3 are enabled to move in a same phase relationship without being hampered.

More specifically, when the two femoral parts 3 are both moved forward, the outer member 18 and the inner member 19 rotate in the same direction and at the same speed relative to each other. Likewise, when the two femoral parts 3 are both moved rearward, the outer member 18 and the inner member 19 rotate in the same direction and at the same speed relative to each other.

Therefore, without rotating the electric motor 4 or without being hampered by the cogging torque of the electric motor 4, the user of the walking assist device 1 is enabled to bend the both femoral parts (for sitting, for example) and to extend the both femoral parts (for standing up, for example) at the same time.

Thus, because the functions of the power transmission mechanism including the function of the differential unit are provided by the bearings 53 for rotatably supporting the outer member 18 of the electric motor 4 on the pelvic frame 13, the right power transmission mechanism 20R connecting the outer member 18 with the right femoral support unit 3R and the left power transmission mechanism 20L connecting the inner member 19 with the left femoral support unit 3L, the overall structure of the power transmission mechanism 20 can be simplified.

Third Embodiment

Figure 7:
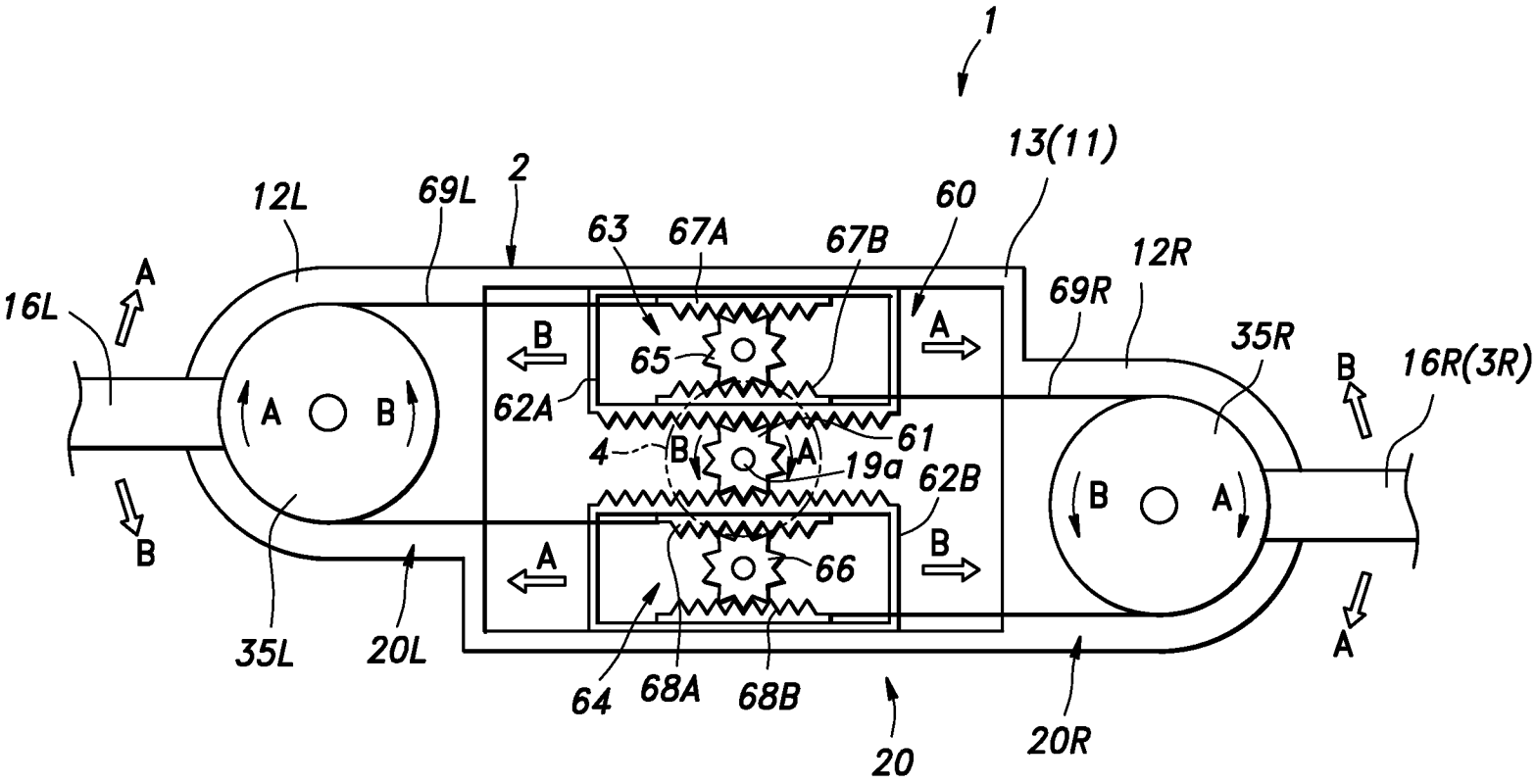
FIG. 7 is a diagram of a walking assist device given as a third embodiment of the present invention.

The walking assist device 1 given as a third embodiment of the present invention is described in the following with reference to FIG. 7 which is a developed view schematically illustrating an essential part of the walking assist device 1. In FIG. 7, the parts corresponding to those of the preceding embodiments are denoted with like numerals without necessarily repeating the discussion of such parts in the following description.

This embodiment also differs from the preceding embodiments in the structure of the power transmission mechanism 20. The output shaft 19*a* of the electric motor 4 which is fixedly attached to the pelvic frame 13 is fixedly fitted with a primary pinion 61, and a pair of racks (a first primary rack 62A and a second primary rack 62B) extending laterally in parallel to each other are mounted on the pelvic frame 13 in a freely slidable manner along the lengthwise direction. The primary pinion 61 meshes with both of these primary racks 62A and 62B. The primary pinion 61 and the first and second primary racks 62A and 62B jointly form a primary rack and pinion mechanism 60. Thus, when the electric motor 4 is actuated, the first and second primary racks 62A and 62B move laterally in mutually opposite directions in synchronism with each other.

Each primary rack 62 is provided with a secondary rack and pinion mechanism 63, 64 (a first secondary rack and pinion mechanism 63 and a second secondary rack and pinion mechanism). Each secondary rack and pinion mechanism 63, 64 includes a secondary pinion 65, 66 rotatably supported by the corresponding primary rack 62A, 62B having a central axial line extending in parallel with that of the primary pinion 61 and a pair of secondary racks 67A, 67B, 68A, 68B which extend in parallel with the primary racks 62A and 62B and supported by the corresponding rack 62A, 62B in a freely slidable manner along the lengthwise direction (the racks of each secondary rack and pinion mechanism may be referred to as the upper secondary rack and the lower secondary rack as shown in the drawings although the terms "upper" and "lower" may not correspond to the actual positioning of these secondary racks).

Each secondary pinion 65, 66 meshes with the corresponding pair of secondary racks 67A, 67B, 68A, 68B. Thus, in each of the secondary rack and pinion mechanisms 63 and 64, each pair of the secondary racks 67A, 67B, 68A, 68B can only move laterally in mutually opposite directions in synchronism with each other. The first secondary pinion 65 and the second secondary pinion 66 are urged by respective biasing means such as torsion coil springs (not shown in the drawings) in the direction to move the first secondary racks 67A and 68A (of the two different secondary rack and pinion mechanisms) in the rightward direction and the second secondary racks 67B and 68B (of the two different secondary rack and pinion mechanisms) in the leftward direction.

A left pulley 35L is integrally attached to the base end of the left femoral arm member 16L forming a part of the left femoral support unit 3L, and a left belt 69L is passed around the left pulley 35L. One end of the left belt 69L is connected to the first secondary rack 67A of the upper secondary rack and pinion mechanism 63 and the other end of the left belt 69L is connected to the first secondary rack 68A of the lower secondary rack and pinion mechanism 64.

A right pulley 35R is integrally attached to the base end of the right femoral arm member 16R forming a part of the right femoral support unit 3R, and a right belt 69R is passed around the right pulley 35R. One end of the right belt 69R is connected to the second secondary rack 67B of the upper secondary rack and pinion mechanism 63, and the other end of the right belt 69R is connected to the first secondary rack 68B of the lower secondary rack and pinion mechanism 64.

The mode of operation of this power transmission mechanism is described in the following.

The rotational output of the electric motor 4 is converted into the linear movements of the first and second primary racks 62A and 62B which are then transmitted to the two femoral support units 3L and 3R via the first and second belts 69L and 69R. When the loadings on the two femoral support units 3L and 3R are equal to each other, no differential movement is caused to the secondary rack and pinion mechanism 63 and 64. Therefore, when the primary pinion 61 is turned in the direction indicated by arrow A, each primary rack 62 moves in the direction indicated by arrow A so that the left belt 69L rotatively actuates the left pulley 35L, along with the left femoral arm member 16L, in the direction indicated by arrow A or in the forward direction while the right belt 69R rotatively actuates the right pulley 35R, along with the right femoral arm member 16R, in the direction indicated by arrow A or in the rearward direction. Conversely, when the primary pinion 61 is turned in the direction indicated by arrow B, each primary rack 62 moves in the direction indicated by arrow B with the result that the left femoral arm member 16L and the right femoral arm member 16R are rotatively actuated in the direction indicated by arrows B.

Thus, the power transmission mechanism 20 of the third embodiment includes a pair of secondary rack and pinion mechanisms 63 and 64, and the left belt 69L which is passed around the left pulley 35L is connected between the secondary racks 67A and 68A of the different secondary rack and pinion mechanisms 63 and 64 while the right belt 69R which passed around the right pulley 35R is connected between the secondary racks 67B and 68B of the different secondary rack and pinion mechanisms 63 and 64. Therefore, the two femoral support units 3 are enabled to move simultaneously forward or rearward or to move in the opposite phase relationship without causing the rotation of the electric motor 4.

More specifically, when the left femoral arm member 16L moves forward as indicated by arrow A and the right femoral arm member 16R moves also forward as indicated by arrow B, the primary rack and pinion mechanism 60 does not operate, and the first secondary rack 67A of the first secondary rack and pinion mechanism 63 moves rightward (aided by the urging force of the biasing means), the first secondary rack 68A of the second secondary rack and pinion mechanism 64 moves leftward (against the urging force of the biasing means), the second secondary rack 67B of the first rack and pinion mechanism 63 moves leftward (aided by the urging force of the biasing means), and the second secondary rack 68B of the second secondary rack and pinion mechanism 64 moves rightward (against the urging force of the biasing means).

When the left femoral arm member 16L moves rearward as indicated by arrow B and the right femoral arm member 16R moves also rearward as indicated by arrow A, the primary rack and pinion mechanism 60, again, does not operate, and the first secondary rack 67A of the first secondary rack and pinion mechanism 63 moves leftward (against the urging force of the biasing means), the first secondary rack 68A of the second secondary rack and pinion mechanism 64 moves rightward (aided by the urging force of the biasing means), the second secondary rack 67B of the first rack and pinion mechanism 63 moves rightward (against the urging force of the biasing means), and the second secondary rack 68B of the second secondary rack and pinion mechanism 64 moves leftward (aided by the urging force of the biasing means).

Therefore, without rotating the electric motor 4 or without being hampered by the cogging torque of the electric motor 4, the user of the walking assist device 1 is enabled to bend the both femoral parts (for sitting, for example) and to extend the both femoral parts (for standing up, for example) at the same time.

The third embodiment provides advantages similar to those of the preceding embodiments.

Fourth Embodiment

The walking assist device 1 given as a fourth embodiment of the present invention is described in the following with reference to FIGS. 8 to 11.

In the walking assist device 1 of the fourth embodiment, a fluid pump 70 consisting of a double acting displacement pump is attached to the pelvic frame 13 of the pelvic support unit 2, and a pair of fluid actuators 71L and 71R also of a double acting type are provided in the junctions between the side frames 12L and 12R and the corresponding femoral support units 3R and 3L, respectively. In the illustrated embodiment, the fluid pump 70 uses bellows for creating chambers whose volumes can change, but may also use a regular cylinder receiving a reciprocating piston therein or any other pump elements.

Figure 9A:
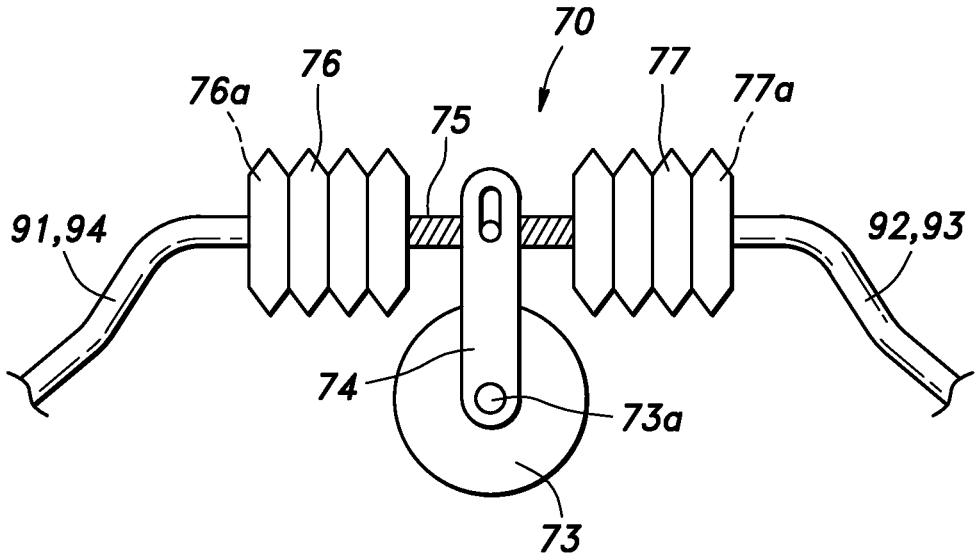
FIGS. 9*a* and 9*b* are diagrams showing the mode of operation of the hydraulic pump used in the fourth embodiment.
Figure 9B:
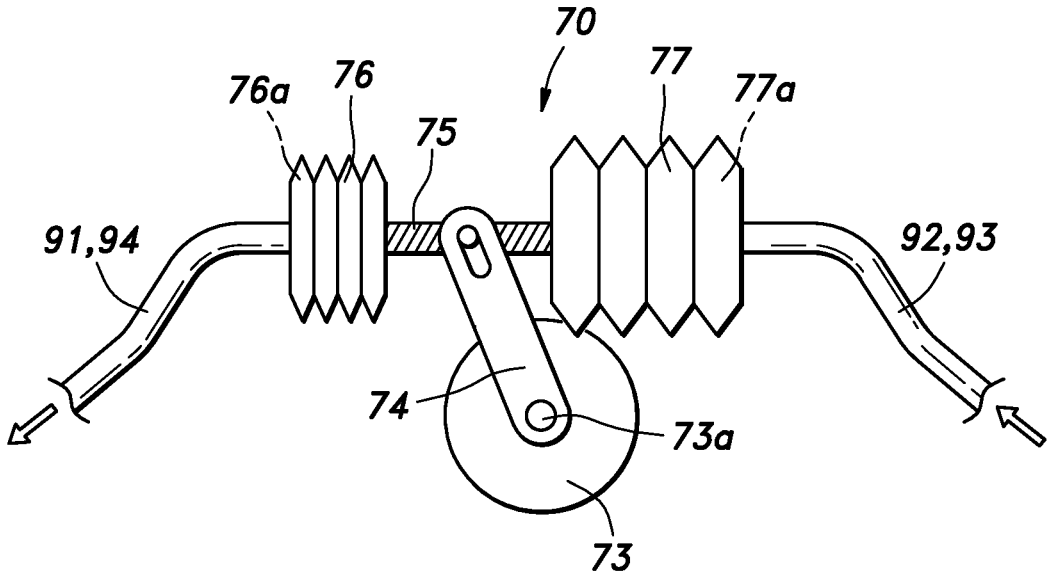

As shown in FIG. 9, the fluid pump 70 is powered by an electric motor 73 fixedly attached to the pelvic frame 13, and includes a swing arm 74 attached to the output shaft 73*a* of the electric motor 73, a bellows rod 75 having a middle point engaged by the free end of the swing arm 74, a pair of bellows 76 and 77 internally defining a first and a second pump chamber 76*a* and 77*a* and having moveable walls that are connected to the respective ends of the bellows rod 75. The opposite walls of the bellows 76 and 77 are fixed to the pelvic frame 13. The first and second pump chambers 76*a* and 77*a* are filled with suitable actuating fluid which may be either gas or liquid. Thus, when the swing arm 74 is tilted in either direction by the output shaft 73*a* of the electric motor 73, the moveable walls of the bellows 76 and 77 are displaced in such a manner that the volume of one of the pump chambers 76*a*, 77*a* is reduced, and the volume of the other pump chamber 76*a*, 77*a* is increased by the same amount. A suitable reduction gear mechanism may be interposed between the output shaft 73*a* of the electric motor 73 and the swing arm 74.

Figures 8A, 8B, 8C:
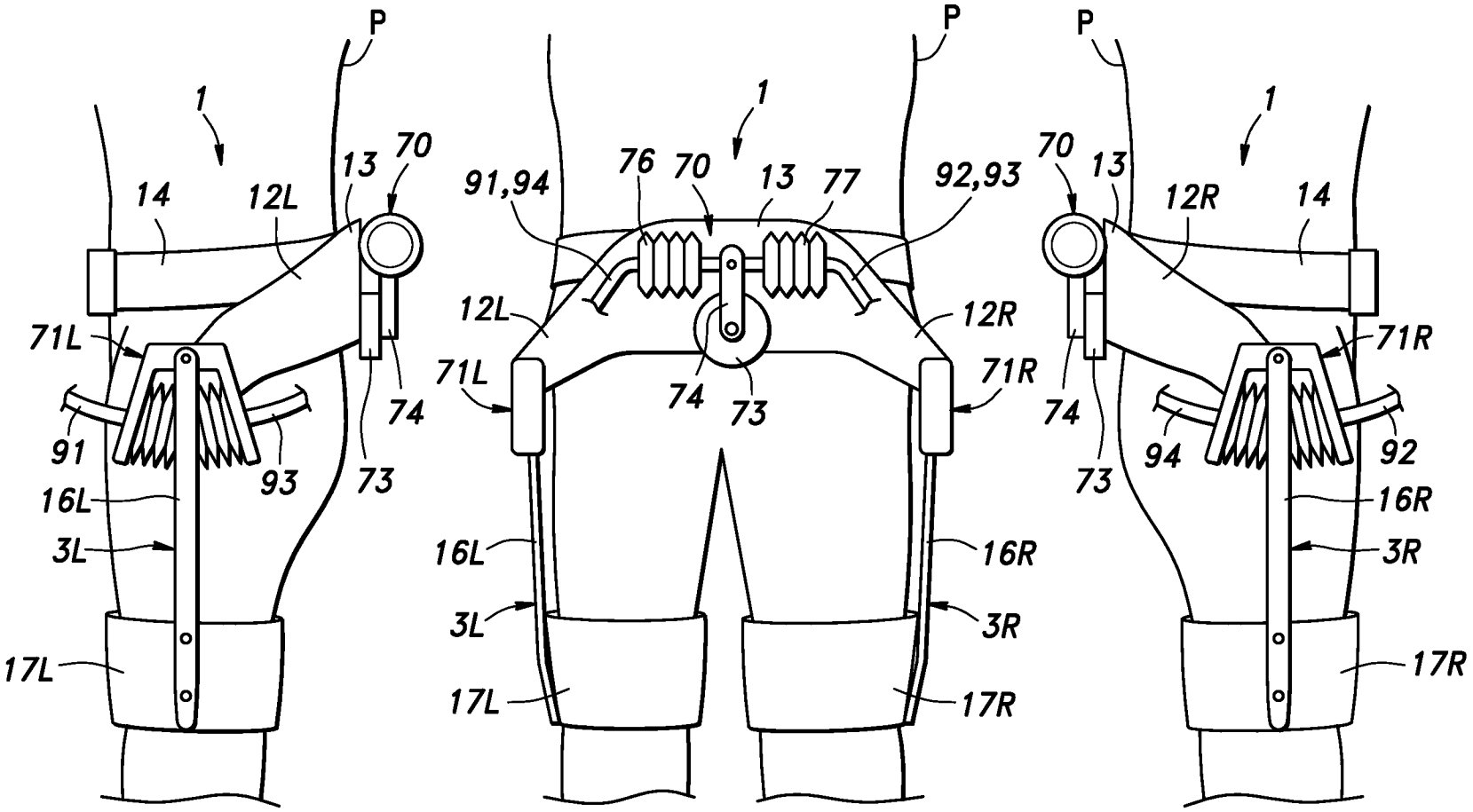
FIG. 8*a* is a left side view of a walking assist device given as a fourth embodiment of the present invention.
FIG. 8*b* is a rear view of the fourth embodiment of the present invention.
FIG. 8*c* is a right side view of the fourth embodiment of the present invention.
Figure 10A:
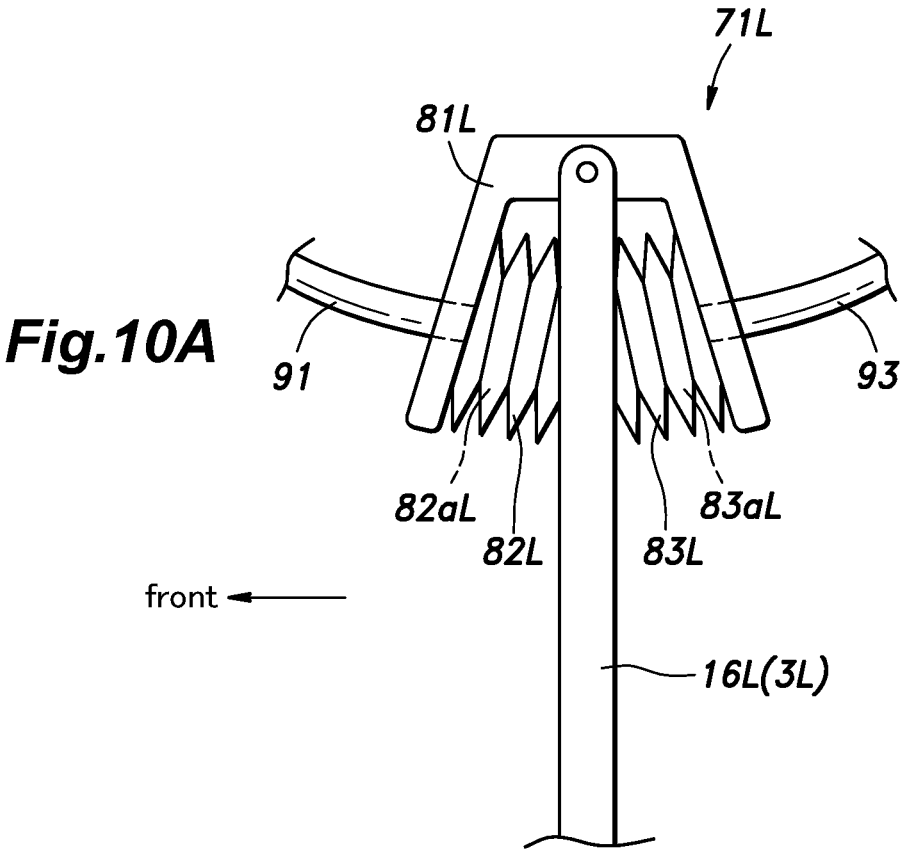
FIGS. 10*a* and 10*b* are diagrams showing the mode of operation of the hydraulic actuators used in the fourth embodiment.
Figure 10B:
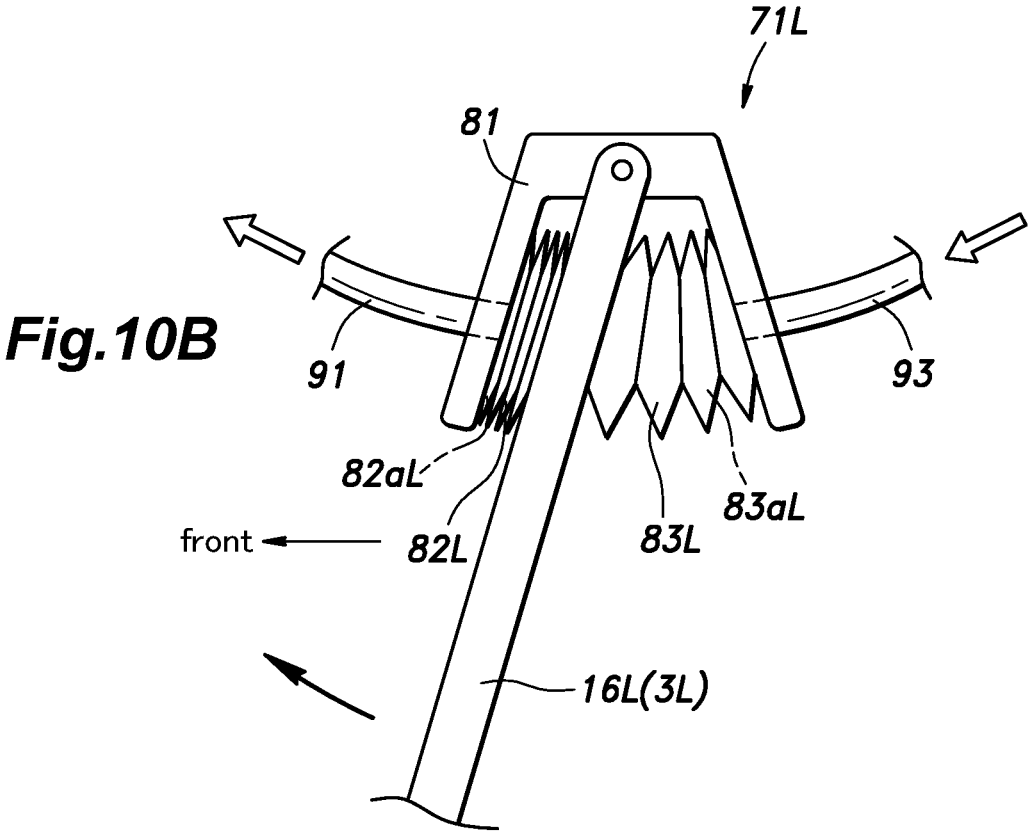

As shown in FIGS. 8 and 10, each fluid actuator 71 includes a housing 81 fixedly secured to the corresponding side frame 12, and a pair of bellows 82 and 83 connected in series, and having respective fixed walls at opposite ends thereof and a common moveable wall which is connected to the femoral arm member 16. The bellows 82 and 83 internally define first and second fluid chambers 82*a* and 83*a*, respectively. Therefore, by changing the volumes of the first and second fluid chambers 82*a* and 83*a* in a complementary manner or by supplying a certain amount of fluid to one of the fluid chambers 82*a*, 83*a*, and drawing the same amount of fluid from the other fluid chamber 82*a*, 83*a*, the femoral arm member 16 is caused to swing in the corresponding direction.

Figure 11:
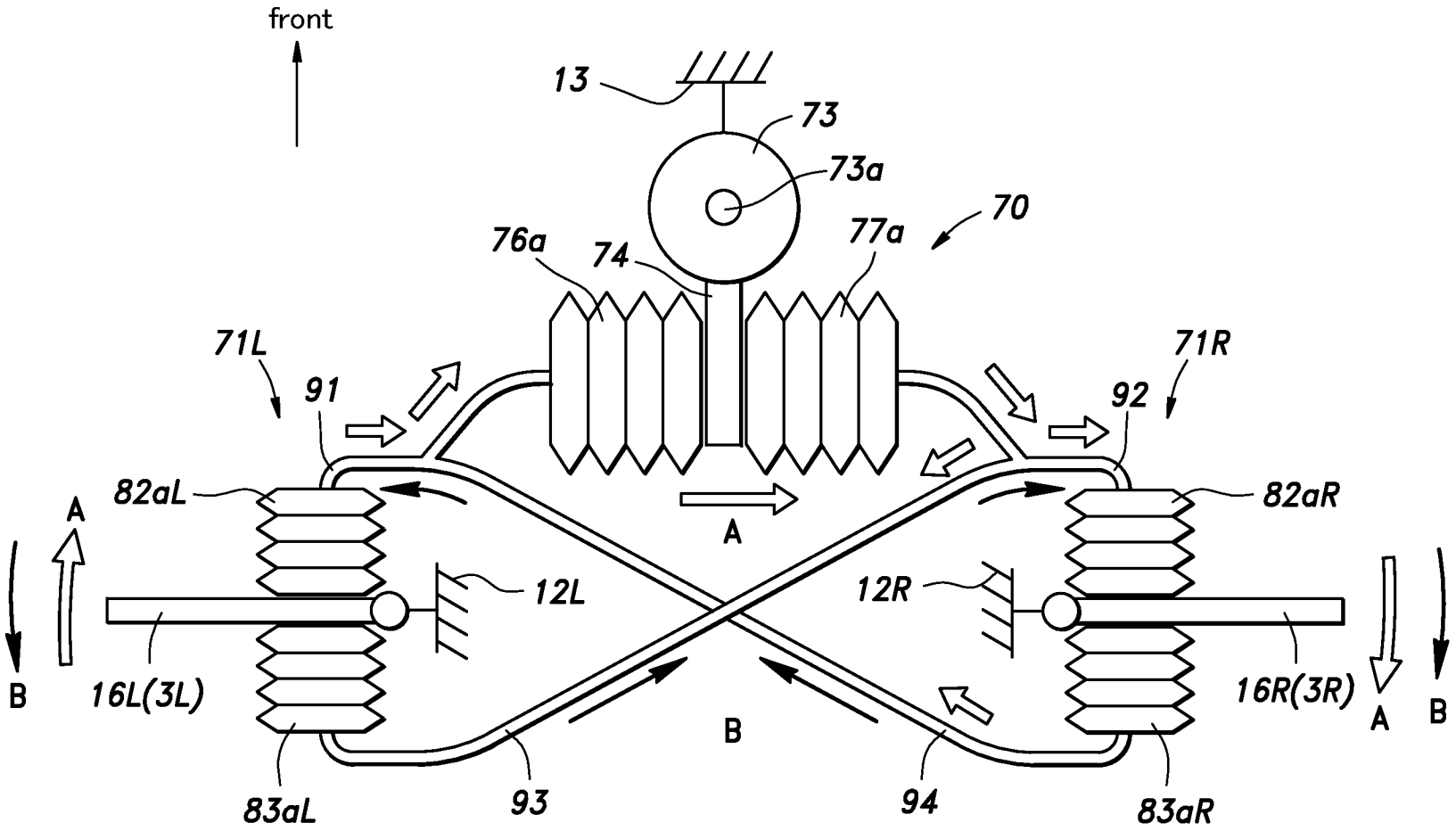
FIG. 11 is an overall diagram showing the mode of operation of the walking assist device of the fourth embodiment.

As shown in FIG. 11, the fluid pump 70 and the two fluid actuators 71 are connected to one another by a plurality of fluid passages 91 to 94. Specifically, the first pump chamber 76*a* is connected to the first fluid chamber 82*a* L of the left fluid actuator 71L via a first passage 91, and the second pump chamber 77*a* is connected to the first fluid chamber 82*a*R of the right fluid actuator 71R via a second passage 92. The second fluid chamber 83*a*L of the left fluid actuator 71L is connected to the second pump chamber 77*a* via a third passage 93, and the second fluid chamber 83*a*R of the right fluid actuator 71R is connected to the first pump chamber 76*a* via a fourth passage 94.

In the illustrated embodiment, the first passage 91 and the fourth passage 94 are commonly connected to the first pump chamber 76*a*, and the second passage 92 and the third passage 93 are commonly connected to the second pump chamber 77*a*.

The mode of operation of the power transmission mechanism 20 of the fourth embodiment is described in the following.

When the loadings to the right and left femoral support units 3 are equal to each other, the rotation of the output shaft 73*a* of the electric motor 73 causes the swing arm 74 to swing in one direction, rightward for instance, as indicated by arrow A such that the volume of the first pump chamber 76*a* increases while the volume of the second pump chamber 77*a* decreases by the corresponding amount. As a result, the fluid in the second pump chamber 77*a* is equally distributed between the second passage 92 and the third passage 93 to be conducted into the first fluid chamber 82*a*R of the right fluid actuator 71R and the second fluid chamber 83*a*L of the left fluid actuator 71L. At the same time, the same amount of fluid is expelled from the second fluid chamber 83*a*R of the right fluid actuator 71R and the first fluid chamber 82*a*L of the left fluid actuator 71L flows into the first pump chamber 76*a* via the fourth passage 94 and the first passage 91, respectively. As a result, the left arm member 16L moves forward as indicated by arrow A, and the right arm member 16R moves rearward as indicated by arrow A. The right and left femoral arm members 16 thus receive a same torque from the power transmission mechanism 20.

Because the first passage 91 and the fourth passage 94 communicate with each other, and the second passage 92 and the third passage 93 communicate with each other, the two femoral support units 3 are enabled to move jointly forward or rearward or to perform an opposite phase motion without involving the rotation of the output shaft 73*a* of the electric motor 73.

More specifically, when both the femoral arm members 16 move rearward as indicated by arrows B, there is no inflow into or outflow from either the first chamber 76*a* or the second chamber 77*a*, and the actuating fluid flows from the second fluid chamber 83*a*R of the right fluid actuator 71R to the first fluid chamber 82*a*L of the left fluid actuator 71L, and from the second fluid chamber 83*a*L of the left fluid actuator 71L to the first fluid chamber 82*a*R of the right fluid actuator 71R. Also, when both the femoral arm members move forward, there is no inflow into or outflow from either the first chamber 76*a* or the second chamber 77*a*, and the actuating fluid simply moves between the two fluid actuators 71.

Therefore, without rotating the electric motor 73 or without being hampered by the cogging torque of the electric motor 73, the user of the walking assist device 1 is enabled to bend the both femoral parts (for sitting, for example) and to extend the both femoral parts (for standing up, for example) at the same time.

In the illustrated embodiment, the first passage 91 and the fourth passage 94 were communicated with each other by branching off the first passage 91 from the fourth passage 94, but may also be connected in different ways as long as one of the pump chambers 76*a*, 77*a* is communicated with the corresponding fluid chambers 82*a*L, 83*a*R, 83*a*L, 83*a*R of the two fluid actuators 71L and 71R. The same is true with the second passage 92 and the third passage 93.

The fourth embodiment provides advantages similar to those of the preceding embodiments.

Although the present invention has been described in terms of specific embodiments, the present invention is not limited by such embodiments, but may be modified and substituted in a number of different ways without departing from the spirit of the present invention.

The foregoing embodiments were directed to walking assist devices 1 for assisting the walking movement of a user, but may also be constructed as devices for assisting the movement of other parts of the user during walking or in other situations. For instance, the device of the present invention may also be used for assisting the movement of the humeral parts of the user.

The two femoral support units 3 in the foregoing embodiments were rotatably attached to the frame part of the pelvic support unit 2, but the pelvic support unit 2 may also consist solely of a flexible belt which directly supports the femoral support units 3 in a rotatable manner. In such a case, the drive unit and the battery 7 may be supported at any single part of the pelvic support unit 2 or may be divided into a plurality of different components so that each component may be supported by the pelvic support unit 2 at a plurality of different parts thereof.

Also, in any of the foregoing embodiments, it should be understood that any other controllable power sources such as hydraulic motors and pneumatic motors may be used in place of the electric motor 4, 73, and the motor may be incorporated with a reduction gear unit without departing from the spirit of the prevent invention. In the first embodiment, instead of providing the counter gear 38, one of the belts 36L and 36R may consist of a crossed belt so that the rotational direction may be reversed.

The original Japanese patent application on which the Convention priority is claimed for this application and any references mentioned in this application are hereby incorporated into this application by reference.

The invention claimed is:

1. A motion assist device for assisting a motion of a user, comprising:

a pair of body part support units configured to be worn by two body parts of a user;

a single power source for producing power; and a power transmission unit for transmitting the power of the power source to the body part support units as an opposite phase motion at the same time;

wherein the power transmission unit includes a differential unit for accommodating a same phase motion of the two body part support units, wherein the power source comprises an electric motor, the differential unit includes a differential gear mechanism, and the power transmission unit includes a counter gear provided one of between an output end of the differential gear mechanism and the corresponding body part support unit and between another output end of the differential gear mechanism and the corresponding body part support unit.

2. The motion assist device according to claim 1, wherein the body parts are femoral parts of the user.

3. A motion assist device for assisting a motion of a user, comprising:

a pair of body part support units configured to be worn by two body parts of a user;

a single power source for producing power at an output end thereof;

a power transmission unit for transmitting the power of the power source to the body part support units as an opposite phase motion, the power transmission unit including a differential unit for accommodating a same phase motion of the two body part support units at the same time; and a control unit configured to actuate the power source when the body part support units are undergoing the opposite phase motion, and to keep the output end of the power source stationary when the body part support units are undergoing the same phase motion, wherein the power source comprises an electric motor, the differential unit includes a differential gear mechanism, and the power transmission unit includes a counter gear provided one of between an output end of the differential gear mechanism and the corresponding body part support unit and between another output end of the differential gear mechanism and the corresponding body part support unit.

4. The motion assist device according to claim 3, wherein the body parts are femoral parts of the user.

* * * * *